US007704168B1

(12) United States Patent
Hochberg

(10) Patent No.: US 7,704,168 B1
(45) Date of Patent: Apr. 27, 2010

(54) SELF-RIGHTING TEE BALL STAND

(75) Inventor: Seth Hochberg, Plainville, MA (US)

(73) Assignee: Franklin Sports, Inc., Stoughton, MA (US)

( * ) Notice: Subject to any disclaimer, the term of this patent is extended or adjusted under 35 U.S.C. 154(b) by 0 days.

(21) Appl. No.: 12/357,554

(22) Filed: Jan. 22, 2009

(51) Int. Cl.
*A63B 69/00* (2006.01)

(52) U.S. Cl. ..... 473/417

(58) Field of Classification Search ..... 473/417–420, 473/451
See application file for complete search history.

(56) References Cited

U.S. PATENT DOCUMENTS

| | | | | |
|---|---|---|---|---|
| 2,839,304 | A * | 6/1958 | Lerick | 473/397 |
| 3,183,000 | A * | 5/1965 | Dix | 473/417 |
| 3,876,203 | A * | 4/1975 | Gold | 473/417 |
| 3,877,697 | A * | 4/1975 | Lersch | 473/417 |
| 4,993,708 | A * | 2/1991 | Prossor et al. | 473/417 |
| 5,100,134 | A * | 3/1992 | Becker | 473/417 |
| 5,540,430 | A | 7/1996 | Nichols et al. | |
| 5,772,536 | A * | 6/1998 | Wang | 473/417 |
| 6,045,462 | A | 4/2000 | Mourek | |
| 6,099,418 | A | 8/2000 | Owen | |
| 6,238,307 | B1 * | 5/2001 | Owen | 473/417 |
| 6,551,204 | B1 | 4/2003 | Di Re | |
| 6,682,445 | B1 * | 1/2004 | Tanner | 473/417 |
| 6,695,723 | B2 | 2/2004 | Leal et al. | |
| 6,884,185 | B2 | 4/2005 | Udwin et al. | |
| 6,893,363 | B1 * | 5/2005 | Chen et al. | 473/417 |
| 6,979,273 | B2 | 12/2005 | Tsai | |
| 7,182,705 | B2 | 2/2007 | Lin | |
| 7,226,372 | B2 * | 6/2007 | Flanigan | 473/417 |
| 2006/0258485 | A1 * | 11/2006 | Bandimere et al. | 473/417 |
| 2008/0220910 | A1 * | 9/2008 | Wang | 473/417 |

* cited by examiner

*Primary Examiner*—Mark S Graham
(74) *Attorney, Agent, or Firm*—Joseph B Bowman

(57) ABSTRACT

A self-righting tee ball stand with a base, an adjustable length ball support stanchion and a flex connector joining the base and stanchion to easily yield when the stanchion is struck and to cause the stanchion to return to an upright orientation. The flex connector includes a two-piece rigid outer housing containing a helical spring encased in a cylindrical bellows.

6 Claims, 4 Drawing Sheets

FIG. 3
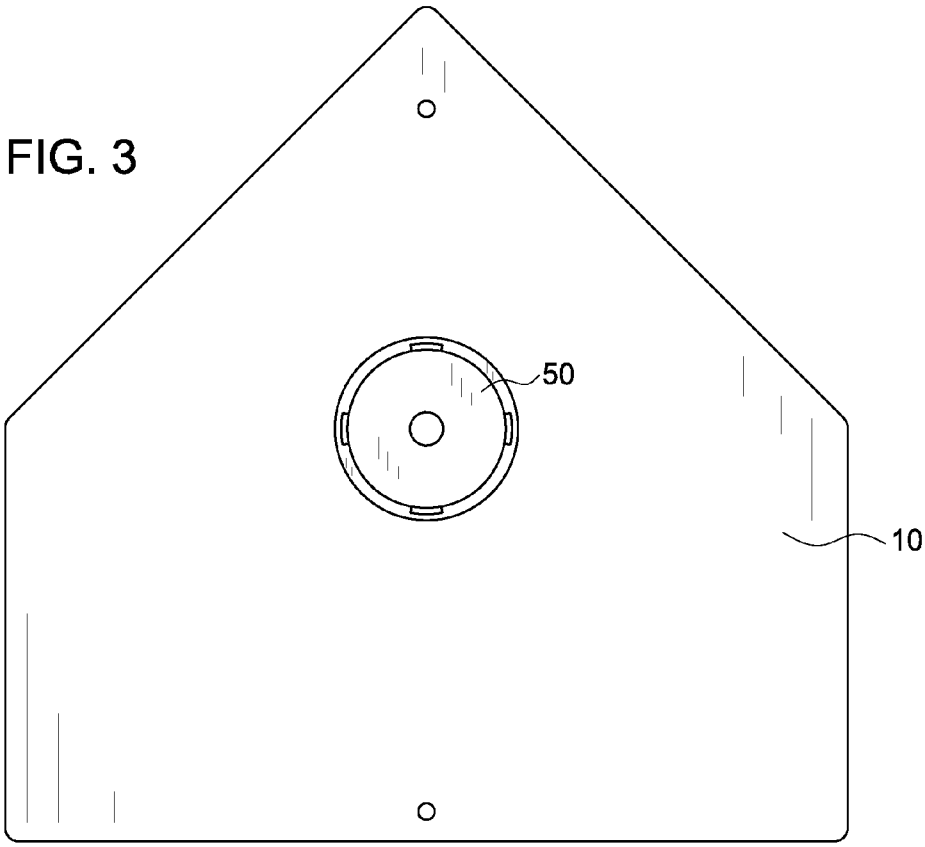
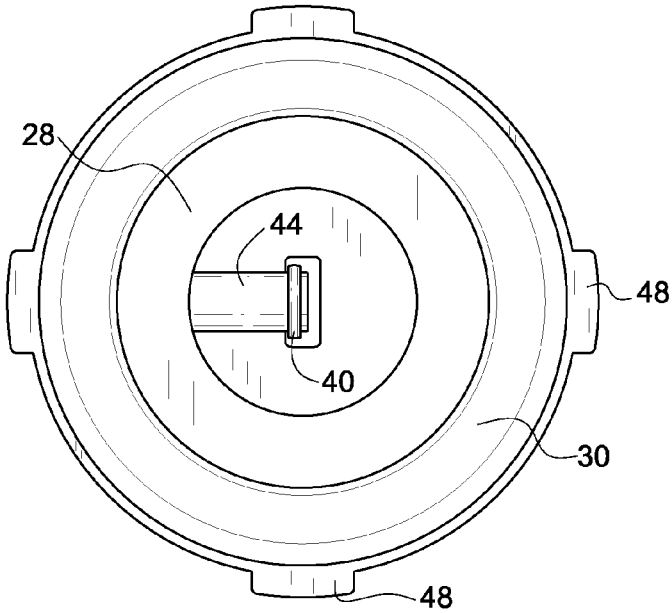
FIG. 4

SELF-RIGHTING TEE BALL STAND

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a tee ball stand. More specifically, this invention relates to a tee ball stand which is self-righting to a vertical orientation in the event the ball holding structure is inadvertently struck instead of the ball itself.

Tee ball stands are characteristically used in the process of teaching young children to hit a ball with a bat. A ball is placed on the end of a pole near the youngster who can then strike at the stationary ball by swinging a bat instead of the more difficult task of attempting to hit a moving ball. With limited experience or limited coordination, the youngster may occasionally strike the pole holding the ball, rather than the ball itself. This can be expected as part of the learning process. As a result, various solutions have been proposed for the safety of the child and for repositioning the tee ball stand in the event of inadvertent and errant bat swings.

U.S. Pat. Nos. 6,045,462, 6,551,204 and 7,226,372 all relate to either flexure or tilting of the vertical ball support pole by some yielding mechanism. Owen U.S. Pat. No. 6,238,307 discloses a helical spring as a shock absorbing element which directly connects the base and the ball support pole of the tee ball stand.

In practice, however, the latter mentioned solution suffers from a number of drawbacks for young children. With the spring member of Owen directly interposed in the ball support member as a shock absorbing element, it is too strong to effectively yield when struck by a bat wielded by a youngster who will still feel the shock of impact through the bat. If, on the other hand, the spring member of Owen is a weaker spring so the youngster will not feel the shock of impact, then the spring will not serve to be self-righting when struck by an errant bat swing.

Therefore, a need remains in the field of youth sports for a safe tee ball stand that will easily yield when struck and still be self-righting in such situations. The primary objective of this invention is to meet this need.

SUMMARY OF THE INVENTION

More specifically, an object of the invention is to provide a tee ball stand that will easily yield from an upright orientation in the event it is struck with an errant bat of a youngster so as to protect the user from experiencing the shock of impact.

Another object of the invention is to provide a tee ball stand of the character described with is self-righting to an upright orientation in the event it is struck by an errant blow.

A further object of the invention is to provide a tee ball stand of the character described which may be quickly and easily assembled and disassembled for storage.

In summary, an object of the invention is to provide a self-righting tee ball stand with a base, an adjustable length ball support stanchion and a flex connection joining the base and stanchion to easily yield when the stanchion is struck and to cause the stanchion to return to an upright orientation. The flex connection includes a two-piece rigid outer housing containing a helical spring encased in a cylindrical bellows.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views:

FIG. 3 is a top plan view of the base of the self-righting tee ball stand;

FIG. 4 is an enlarged bottom plan view of the connection fitting to join the stanchion to the base;

DETAILED DESCRIPTION OF THE DRAWINGS

Figure 1:
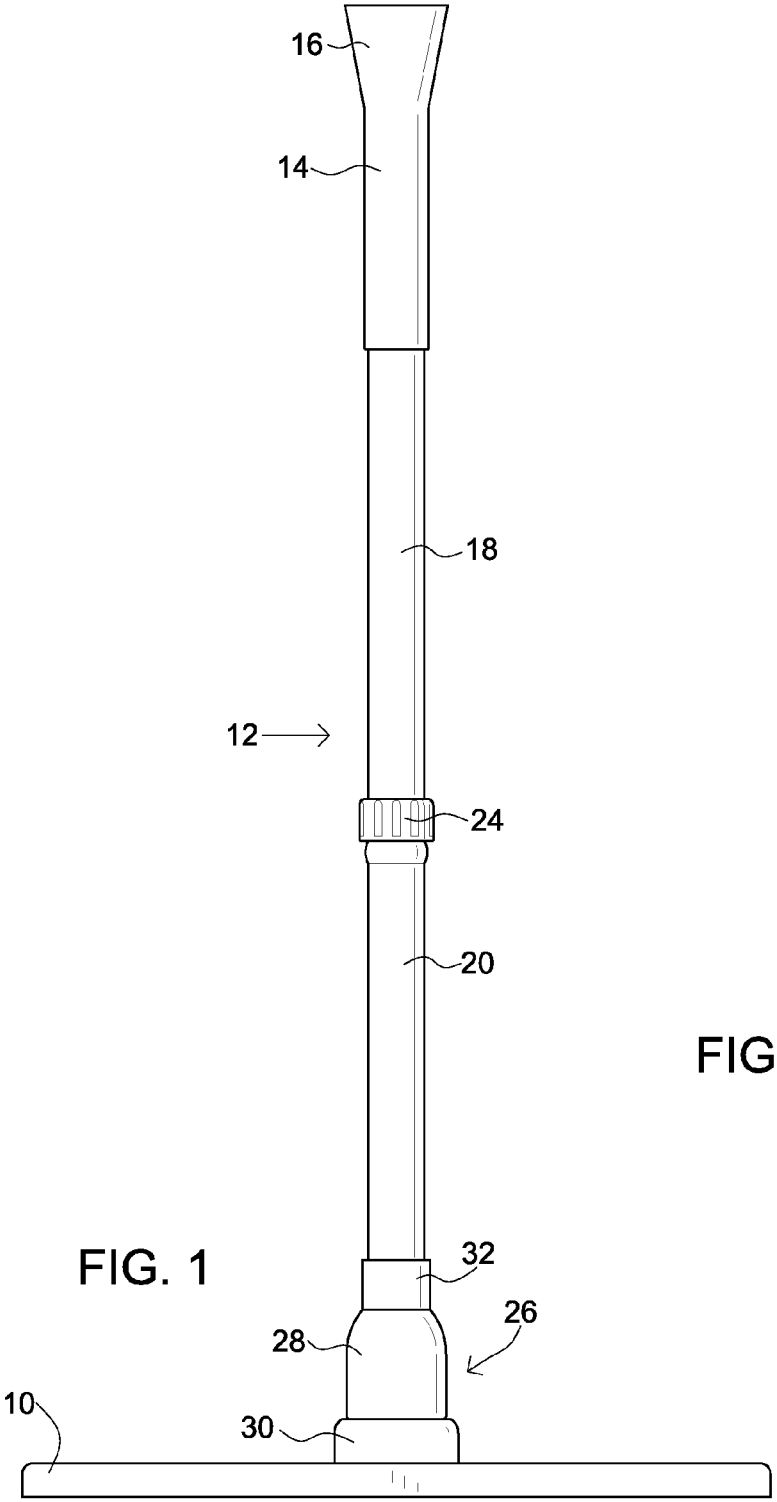
FIG. 1 is a side elevational view of a self-righting tee ball stand constructed in accordance with the invention.
Figure 2:
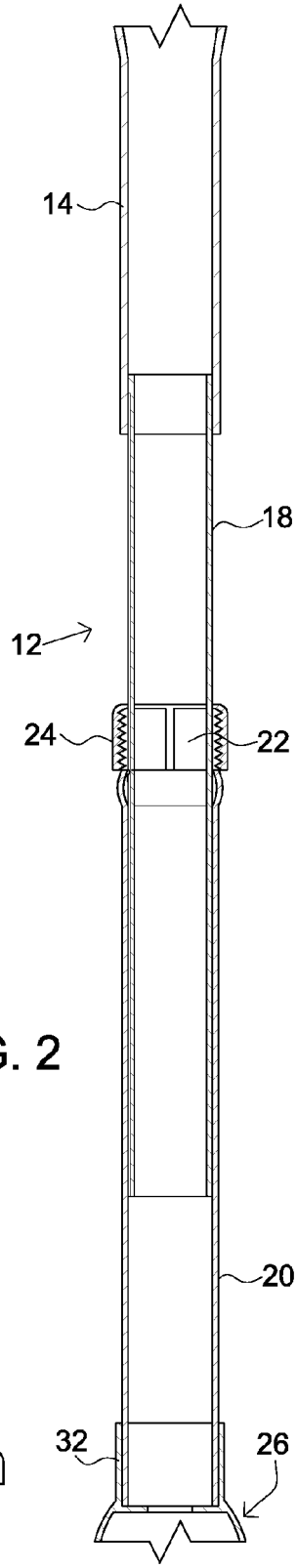
FIG. 2 is an enlarged sectional view of the stanchion shown in FIG. 1 to illustrate the adjustment mechanism to vary the length of the stanchion.

Referring to the drawings in greater detail, the tee ball stand includes a ground engaging support base as illustrated in FIGS. 1 & 3. The base 10 may be shaped to correspond to a "home base" pad commonly used in baseball as shown in FIG. 3 or may be formed in any convenient shape having sufficient width, breadth and weight to provide a solid platform for the other parts of the tee ball stand.

Removably secured to the base 10 is a stanchion generally designated by the numeral 12. Atop the upper end of the stanchion 12 is mounted a ball support 14 with a flared cup 16 sized to hold a conventional tee ball (not shown).

The stanchion 12 itself is a two piece telescoping structure having an upper cylindrical member 18 sized to slip into the inner diameter of a lower cylindrical member 20. The upper end of the lower cylindrical member 20 includes a split wall flange 22 with exterior threading to receive a compression nut 24. So constructed, the upper member 18 may be extended or retracted within the lower member 20 to vary the overall length of the stanchion 12 and then locked at a preselected length by tightening the compression nut 24 to prevent movement of the upper member 18 with respect to the lower member 20.

Figure 5:
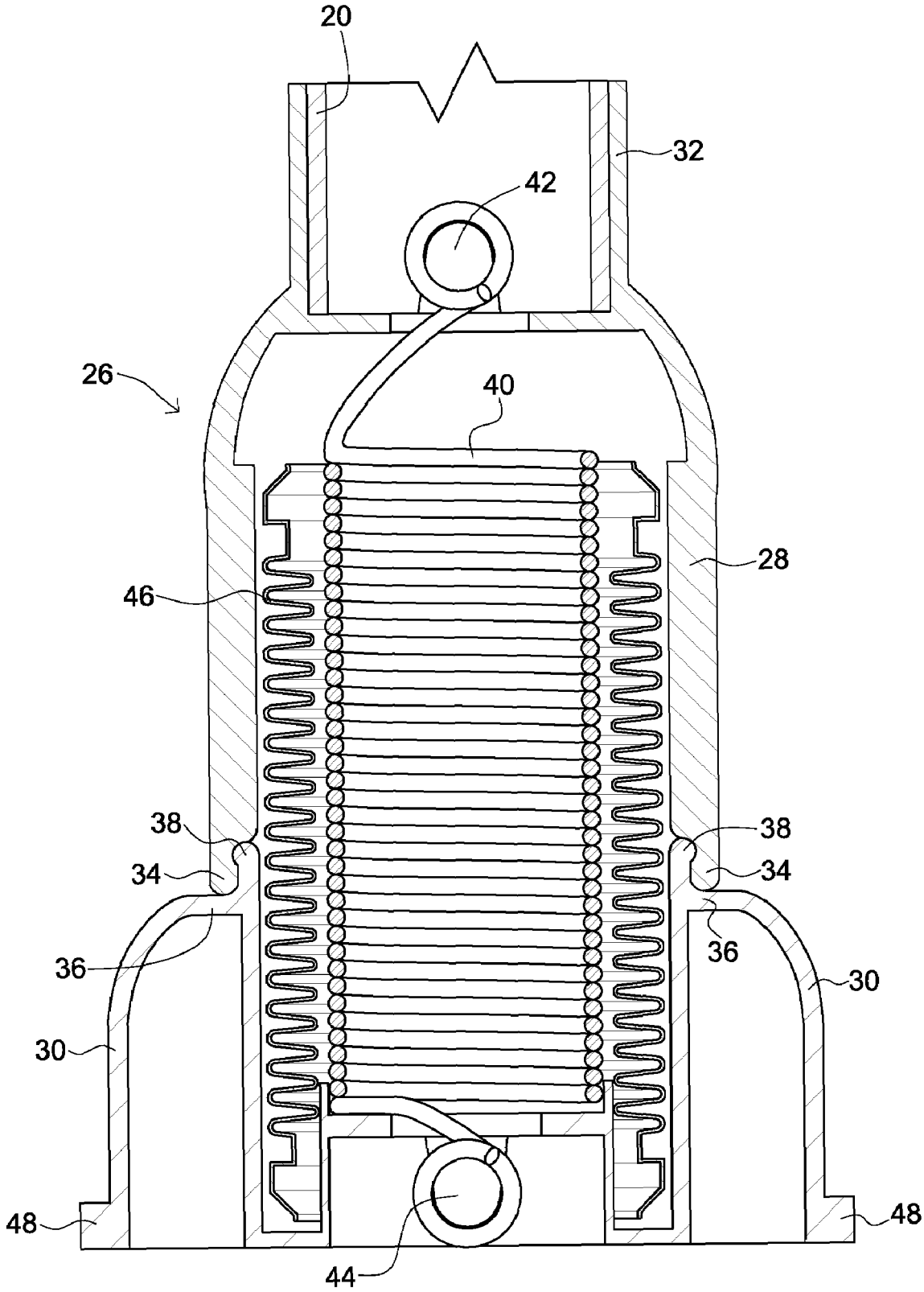
FIG. 5 is an enlarged sectional view of the flex connection between the upright stanchion and the base.
Figure 6:
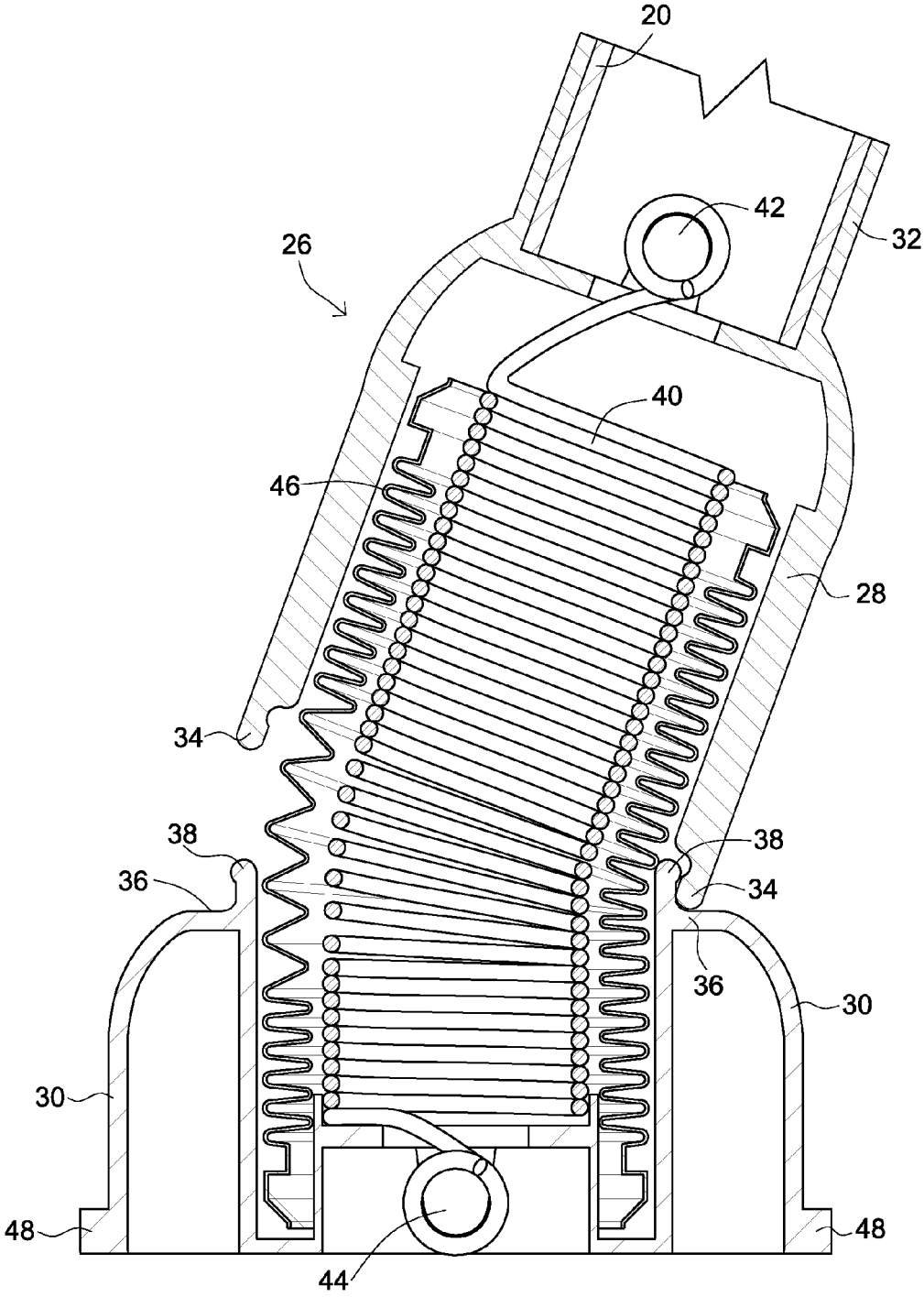
FIG. 6 is an enlarged sectional view similar to FIG. 5 but shown the flex connection pivoted to one side.

Joining the lower end of the stanchion 12 to the base 10 is a flex connector 26 formed as a two piece rigid housing having upper and lower sections 28 & 30 respectively. As viewed in the sectional views of FIGS. 5 & 6, the housing sections 28 & 30 are generally bell-shaped. The uppermost end of the upper housing section 28 forms a cylindrical socket 32 which receives the lower end of lower stanchion member 20.

The lowermost end 34 of the upper housing section 28 forms a pivot surface which mates with a corresponding pivot shelf 36 of the lower housing section 30 to permit said upper housing section 28 to pivot in any 360 degree direction from the central vertical axis through the flex connector 26. Interiorly of the pivot shelf 36, the lower housing section 30 includes an upstanding annulus ridge 38 to center the upper housing section 28 with respect to the lower housing section 30.

Within the housing sections 28 & 30 is mounted a helical spring 40 connected at its upper end to a support post 42 integrally formed as a part of the upper housing section 28. The helical spring 40 is connected at its lowermost end to a support post 44 integrally formed as a part of the lower housing section 30. Thus, the spring 40 is tensioned between the upper and lower housing section 28 & 30 to easily yield and permit the upper housing section 28 to pivot with respect to the lower housing section when the stanchion 12 experiences an impact blow.

The helical spring 40 is encircled by a cylindrical bellows 46 connected to the lower housing section 30 and which extends upwardly into the upper housing section 28. The bellows 46 is preferably formed of a resiliently flexible plastic material to assist the helical spring 40 in influencing the stanchion 12 to automatically return to an upright orientation after the stanchion 12 tilts on the base in response to an impact blow.

On the lowermost end of the lower housing section 30 is formed a plurality of locking tabs 48 which are received in a corresponding socket 50 centrally disposed in the base 10 to permit the flex connector 26 to be removably connected to the base 10.

In operation, with the tee ball stand assembled as shown in FIG. 1, a tee ball may be placed atop the ball cup 16. In the event of an errant blow to the stanchion 12 coming from any direction, the flex connector 26 permits the stanchion 12 to yield in any 360 degree direction from the central vertical axis as a result of the upper housing section 28 tilting on the lowermost end 34 supported by the pivot shelf 36 of the lower housing section 30. Subsequently, the helical spring 40 and bellows 46 act in combination to influence the stanchion 12 to automatically return to an upright orientation on the base. After use to the tee ball stand, the lower housing section 30 may be twisted to register the tabs 48 with the corresponding grooves of the socket 50 of the base in order to separate the flex connector 26 from the base for more convenient storage when the tee ball stand is not in use.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

I claim:

1. A self-righting tee ball stand comprising:

a ground engaging base member;

an upright stanchion having upper and lower ends and being oriented substantially perpendicular to said base;

a ball supporting member mounted on the upper end of sad stanchion;

a flex connector having a rigid, upper section housing connected to said stanchion and a rigid, lower section housing connected to said base member, said flex connector further including a helical spring contained within said upper and lower sections of said housing, said spring having upper and lower ends, said upper end of said spring connected to the upper section of said housing and said lower end of said spring connected to the lower section of said housing to permit three hundred sixty degrees pivotal movement of said stanchion from a perpendicular orientation with said base, but influencing said stanchion to return to said perpendicular orientation in the event any pivotal movement is experienced.

2. The self-righting tee ball stand as in claim 1, the upper section of said housing including a circular pivot surface engaging the lower section of said housing, the lower section of said housing including a circumferential pivot surface normally engaging said circular pivot surface of the upper section of said housing, and the lower section of said housing also including an upright cylindrical ridge inwardly of said circumferential pivot surface to penetrate the upper section of said housing adjacent said circular pivot surface in order to prevent lateral movement between said circular pivot surface and said circumferential pivot surface.

3. The self-righting tee ball stand as in claim 2, including a flexible, cylindrical bellows substantially encasing said helical spring.

4. The self-righting tee ball stand as in claim 1, including a flexible, cylindrical bellows substantially encasing said helical spring.

5. The self-righting tee ball stand as in claim 1, said stanchion including first and second sections telescopingly fitted together with a locking member whereby the overall length of said stanchion may be adjustably varied to present said ball supporting member at a preselected height above said base.

6. The self-righting tee ball stand as in claim 1, said base including a centrally disposed socket link and the lower section of said housing including a locking member to be received by said socket link for removably interlocking said flex connector to said base.

* * * * *